US009010232B2

(12) United States Patent
Tunis et al.

(10) Patent No.: US 9,010,232 B2
(45) Date of Patent: Apr. 21, 2015

(54) VEHICLE WITH STRUCTURAL VENT CHANNELS FOR BLAST ENERGY AND DEBRIS DISSIPATION

(71) Applicant: Hardwire LLC, Pocomoke City, MD (US)

(72) Inventors: George C. Tunis, Ocean City, MD (US); Scott Kendall, Berlin, MD (US)

(73) Assignee: Hardwire, LLC, Pocomoke City, MD (US)

( * ) Notice: Subject to any disclaimer, the term of this patent is extended or adjusted under 35 U.S.C. 154(b) by 0 days.

(21) Appl. No.: 14/082,348

(22) Filed: Nov. 18, 2013

(65) Prior Publication Data

US 2014/0373706 A1 Dec. 25, 2014

Related U.S. Application Data

(63) Continuation of application No. 12/807,818, filed on Sep. 14, 2010, now Pat. No. 8,584,572.

(60) Provisional application No. 61/284,488, filed on Dec. 18, 2009.

(51) Int. Cl.

| | |
|---|---|
| ***F41H 5/14*** | (2006.01) |
| ***F41H 7/04*** | (2006.01) |
| ***F41H 5/007*** | (2006.01) |

(52) U.S. Cl.

CPC ..... *F41H 7/044* (2013.01); *F41H 7/042* (2013.01); *F41H 5/007* (2013.01)

(58) Field of Classification Search

USPC ..... 89/36.01, 36.02, 36.07, 36.08, 36.09, 89/36.11, 36.12, 36.13; 296/187.06, 296/187.07, 187.08

See application file for complete search history.

(56) References Cited

U.S. PATENT DOCUMENTS

| | | | | | |
|---|---|---|---|---|---|
| 2,382,862 | A | * | 8/1945 | Davis, Jr. | 296/187.07 |
| 3,428,141 | A | * | 2/1969 | Binder et al. | 180/68.1 |
| 4,280,393 | A | * | 7/1981 | Giraud et al. | 296/187.07 |
| 4,326,468 | A | * | 4/1982 | King et al. | 109/49.5 |
| 4,329,109 | A | * | 5/1982 | Den Bleyker | 414/685 |
| 4,492,282 | A | * | 1/1985 | Appelblatt et al. | 180/68.1 |
| 5,025,707 | A | * | 6/1991 | Gonzalez | 89/36.17 |
| 5,070,764 | A | * | 12/1991 | Shevach et al. | 89/36.17 |

(Continued)

FOREIGN PATENT DOCUMENTS

| | | | | | |
|---|---|---|---|---|---|
| DE | 4329109 | A1 | * | 3/1995 | D06C 15/08 |
| GB | 2382862 | A | * | 6/2003 | F16K 17/168 |

(Continued)

OTHER PUBLICATIONS

The catamaran tank—an MRAP which doesn't roll over as of Jul. 29, 2010 at http://www.scienceforums.net/topic/50935-the-catamaran-tank-an-mrap-which_doesnt-roll-over.

(Continued)

*Primary Examiner* — Benjamin P Lee

(74) *Attorney, Agent, or Firm* — McLane, Graf, Raulerson & Middleton, PA

(57) ABSTRACT

A vehicle includes one or more structural vent channels for blast energy and gas and debris dissipation. The structural enclosure of a vehicle includes a hull floor and encloses or defines a compartment for crew, cargo, or crew and cargo. The channel provides a passage through, around, or through and around the vehicle, by which blast energy and debris can be dissipated from explosions beneath the vehicle.

19 Claims, 18 Drawing Sheets

(56) References Cited

U.S. PATENT DOCUMENTS

| | | | | |
|---|---|---|---|---|
| 5,472,378 | A * | 12/1995 | Skoff | 454/141 |
| 5,533,781 | A * | 7/1996 | Williams | 296/204 |
| 5,663,520 | A * | 9/1997 | Ladika et al. | 296/187.07 |
| 6,658,984 | B2 * | 12/2003 | Zonak | 296/193.07 |
| 6,779,431 | B2 * | 8/2004 | Honlinger | 296/193.07 |
| 6,782,793 | B1 * | 8/2004 | Lloyd | 89/36.17 |
| 7,228,927 | B2 * | 6/2007 | Hass et al. | 180/65.25 |
| 7,255,034 | B2 * | 8/2007 | Strassgurtl et al. | 296/193.07 |
| 7,357,062 | B2 * | 4/2008 | Joynt | 89/36.08 |
| 7,594,561 | B2 * | 9/2009 | Hass et al. | 180/299 |
| 7,685,924 | B2 * | 3/2010 | Barbe et al. | 89/36.09 |
| 7,712,823 | B2 * | 5/2010 | Greuter et al. | 296/187.07 |
| 7,836,810 | B2 * | 11/2010 | Meyer | 89/36.17 |
| 7,856,762 | B2 * | 12/2010 | Deisenroth et al. | 52/79.1 |
| 7,905,540 | B2 * | 3/2011 | Kiley et al. | 296/193.04 |
| 7,954,419 | B2 * | 6/2011 | Ran et al. | 89/36.08 |
| 7,987,762 | B2 * | 8/2011 | Joynt et al. | 89/36.02 |
| 8,033,208 | B2 * | 10/2011 | Joynt et al. | 89/36.08 |
| 8,205,703 | B2 * | 6/2012 | Halliday | 180/89.1 |
| 2006/0201318 | A1 * | 9/2006 | LaBrash et al. | 89/36.02 |
| 2007/0186762 | A1 * | 8/2007 | Dehart et al. | 89/36.09 |
| 2007/0234896 | A1 * | 10/2007 | Joynt | 89/36.09 |
| 2008/0066613 | A1 * | 3/2008 | Mills et al. | 89/36.09 |
| 2008/0105114 | A1 * | 5/2008 | Gabrys | 89/36.02 |
| 2010/0011948 | A1 * | 1/2010 | Johnson et al. | 89/36.02 |
| 2010/0163330 | A1 * | 7/2010 | Halliday | 180/295 |
| 2010/0275766 | A1 * | 11/2010 | Joynt et al. | 89/36.02 |
| 2011/0138994 | A1 * | 6/2011 | Joynt et al. | 89/36.08 |
| 2011/0314999 | A1 * | 12/2011 | Luther et al. | 89/36.02 |
| 2012/0180637 | A1 * | 7/2012 | Kocher | 89/36.08 |
| 2012/0181100 | A1 * | 7/2012 | Halliday | 180/291 |
| 2012/0297966 | A1 * | 11/2012 | Hunn et al. | 89/36.02 |

FOREIGN PATENT DOCUMENTS

| | | | | |
|---|---|---|---|---|
| WO | WO 2010123606 | A1 * | 10/2010 | F41H 7/04 |
| WO | WO 2010/128997 | | 11/2010 | |

OTHER PUBLICATIONS

The Science Forum—Scientific Discussion an Debate as of Jul. 29, 2010 at http://www.thescienceforum.com/viewtopic.php?p=254765.

Physics Forums as of Jul. 29, 2010 at http://physicsforums.com/showthread.php?p=2819212#post2819212.

Crain's Detroit Business; Chad Halcom, Badenoch L.L.C. wins $3.8 million Army testing contract; 2010 Crain Communications Inc. as of Jun. 23, 2010 at http://www.crainsdetroit.com/apps/pbcs.dll/article?AID=/20081218/FREE/812189976.

Georgia Tech Research News; Better, Stronger, Faster: New Military Vehicle will Improve Safety and Efficiency for Marine Corps as of Jun. 23, 2010 at http://gtresearchnews.gatech.edu/newsrelease/ultra.htm.

Georgia Tech Research News; Improving Survivability and Mobility: Concept Vehicle Illustrating New Options for Military Combat Vehicles Unveiled as of Jun. 23, 2010 at http://gtresearchnews.gatech.edu/newsrelease/ultra-ap.htm.

Farewell JLTV? So long MRAP? as of Jun. 23, 2010 at http://www.military.com/features/0,15240,163341,00.html.

Third Party Submission in U.S. Appl. No. 12/807,818 dated Aug. 22, 2011.

* cited by examiner

VEHICLE WITH STRUCTURAL VENT CHANNELS FOR BLAST ENERGY AND DEBRIS DISSIPATION

CROSS REFERENCE TO RELATED APPLICATIONS

This application claims the benefit under 35 U.S.C. §119 (e) of U.S. Provisional Patent Application No. 61/284,488, filed Dec. 18, 2009, the disclosure of which is incorporated by reference herein.

This application claims the benefit under 35 U.S.C. §120 of U.S. application Ser. No. 12/807,818, filed Sep. 14, 2010, the entire disclosure of which is incorporated herein by reference.

STATEMENT REGARDING FEDERALLY SPONSORED RESEARCH OR DEVELOPMENT

This invention was made with Government support under Agreement No. HR-0011-09-9-0001, by DARPA. The Government has certain rights in the invention.

BACKGROUND OF THE INVENTION

In armed conflicts, land mines are a serious threat to people or vehicles traveling on the ground. In recent conflicts around the world, attacks from improvised explosive devices (IED) are becoming more common. IEDs may also include some form of armored penetrator, including explosively formed penetrators (EFP). Armored vehicles, such as the Mine Resistant Ambush Protected (MRAP) vehicle, have been designed to help withstand these attacks and minimize harm to the vehicle's occupants.

SUMMARY OF THE INVENTION

A vehicle is provided with one or more structural channels that help to dissipate blast energy and debris from explosions. In one embodiment, the channel, which is open at both ends, extends vertically through the vehicle. The channel thereby provides a passage through the vehicle for blast energy and gas and debris from an explosion beneath the vehicle. The soldiers in the crew compartment remain isolated and protected from damaging effects of the explosion.

The channel can have a variety of configurations. For example, the channel can be in the configuration of a straight-sided cylinder with a round, rectangular, or other cross-section. The channel can include a converging section and/or a diverging section to provide a nozzle to further accelerate debris through the passage. The channel can be in the configuration of a slot open toward the rear, sides, or front of the vehicle. Multiple channels can be provided in a single vehicle.

The channel is structurally attached to the structure of the vehicle, becoming another structural component of the vehicle. In particular, the channel is structurally attached to the hull floor, thereby strengthening and adding rigidity to the hull floor. This further increases the ability of the vehicle to withstand an explosion from underneath. The hull floor can be shaped to function cooperatively with the channel. For example, the hull floor can be V-shaped, which further redirects outwardly from the vehicle any blast energy and debris that is not directed into the channel. In one embodiment, the hull floor is formed with multiple pyramid shapes nested within a base of a larger truncated pyramid shape. The channel can also serve as a mount for a platform or accessories, or as a pick point for lifting or picking the vehicle off the ground.

In another embodiment, the channel is formed from one or more elements having a surface shaped to redirect a blast flow originating beneath the structural enclosure, the surface attached to the structural enclosure adjacent a side of the hull floor.

DESCRIPTION OF THE DRAWINGS

The invention will be more fully understood from the following detailed description taken in conjunction with the accompanying drawings in which.

DETAILED DESCRIPTION OF THE INVENTION

Figure 1:
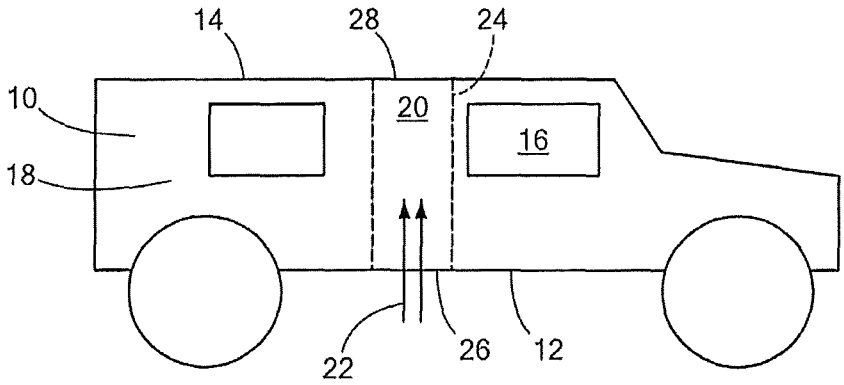
FIG. 1 is a schematic illustration of a side view of a vehicle incorporating a structural channel.

The disclosures of U.S. Provisional Patent Application No. 61/284,488, filed Dec. 18, 2009, and U.S. patent application Ser. No. 12/807,818, filed Sep. 14, 2010, are incorporated by reference herein.

A vehicle 10, generally an armored vehicle such as an MRAP (mine resistant ambush protected) vehicle or HMMWV (high mobility multipurpose vehicle), is provided with one or more structural channels 20 that extend fully through the vehicle from the floor 12 to the roof 14 of the vehicle. See FIGS. 1 and 2. The blast shock wave and high velocity gas and debris are vented directly through the channel 20 in the vehicle, indicated by arrows 22, thus reducing the blast effects on the vehicle. The crew (and/or cargo) compartment 16 is sealed from the interior of the channel, thereby helping to isolate and protect the crew (and/or cargo) from the blast effects. The channel can occupy a minimal amount of interior space within the vehicle, generally within the vehicle's center.

The channel 20 vents energy from an explosive blast through the vehicle early in the event. The vertical vector component of the directed energy from the blast is often the most damaging. Thus, the vertical orientation of the channel transmits the energy and gas and debris through and out the top of the vehicle before they can do more serious damage to the vehicle and its crew. The channel operates nearly instantaneously, allowing blast gas and debris to pass through the vehicle structure with minimal redirection or drag. The vehicle's occupants are substantially separated and insulated from the event.

The channel wall or walls 24 also form a structural element of the vehicle 10 by supporting the hull floor 12 or underbelly pan and transferring the load from the underbelly pan into the upper structure 18 of the vehicle. The channel thus provides another load path through the vehicle in addition to the vehicle's structural pillars. As a structural supporting element, the channel shortens the unsupported span length of the floor and roof in the vehicle. The channel wall or walls can also be designed to buckle to absorb un-vented energy that is transferred to the vehicle.

The channel 20 is structurally connected directly to the structural enclosure of the vehicle in any suitable manner. In particular, the channel is structurally attached to the hull floor 12 (the portion of the vehicle structure between the compartment 16 and the ground), thereby strengthening and adding rigidity to the hull floor. For example, the channel can be formed from a tube open at the top and bottom ends 26, 28 and attached to the floor 12 by welding or other suitable attachment mechanism. The tube is generally attached to the roof 14 of the vehicle. However, the channel can also be provided with vehicles having a non-structural roof or rag top. The channel can also be integrally formed with the structural enclosure of the vehicle. The channel can be used with any type of structural enclosure for a vehicle, such as a body-on-frame, body-frame integral, unibody or monocoque.

Figure 2:
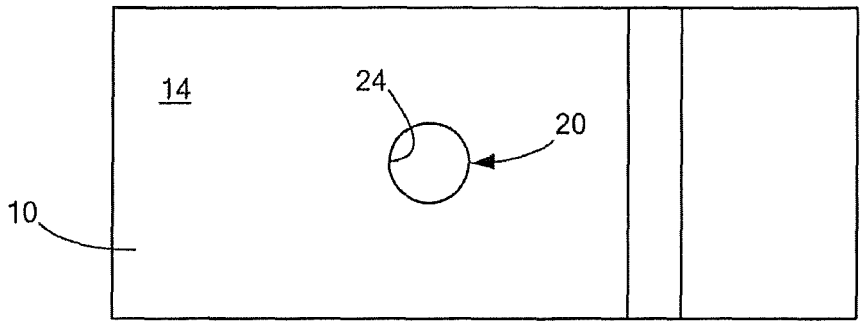
FIG. 2 is a schematic illustration of a top plan view of the vehicle of FIG. 1.
Figure 3:
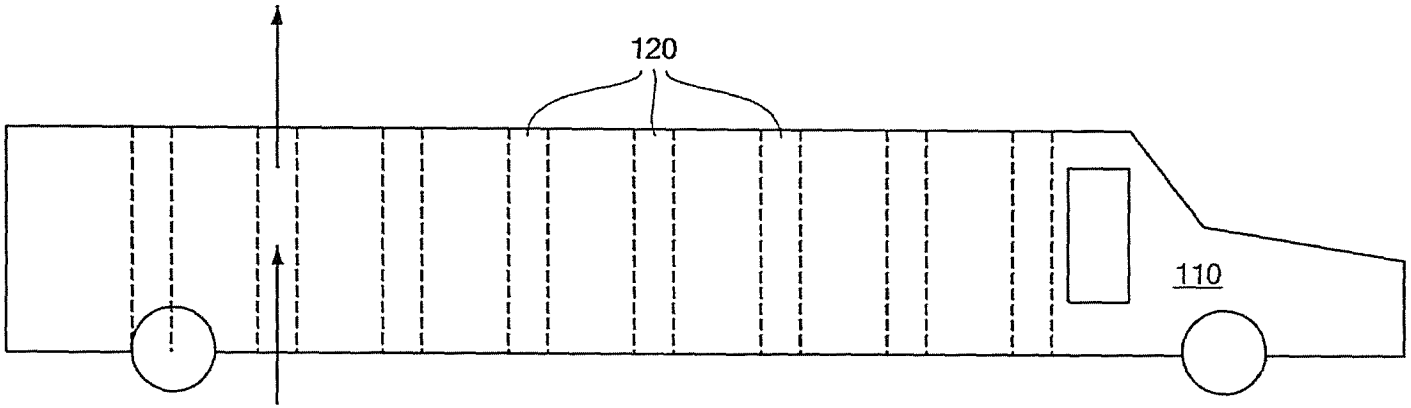
FIG. 3 is a schematic illustration of a side view of a long vehicle incorporating multiple channels.
Figure 4:
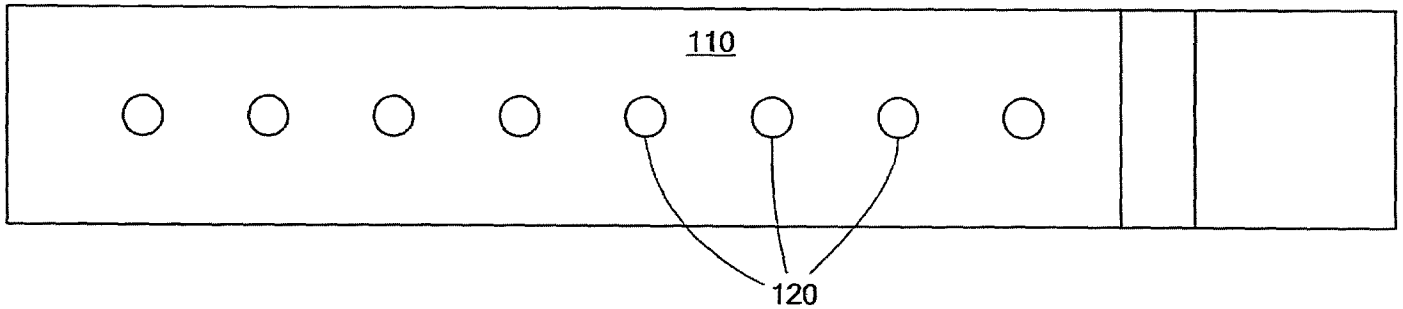
FIG. 4 is a schematic illustration of a top plan view of the vehicle of FIG. 3.
Figure 5:
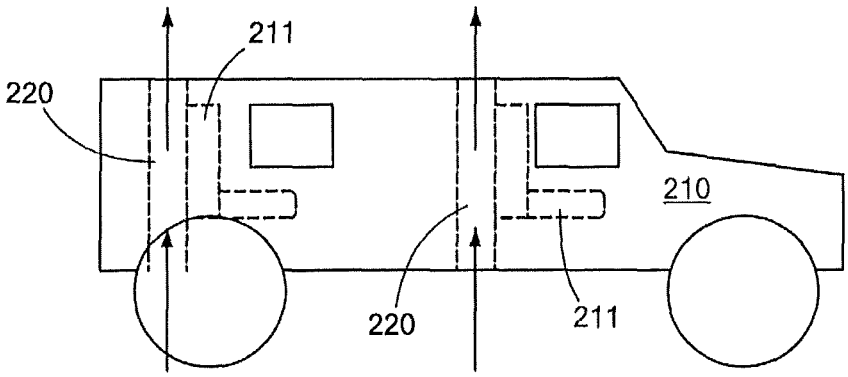
FIG. 5 is a schematic illustration of a side view of a vehicle incorporating channels as seat supports.
Figure 6:
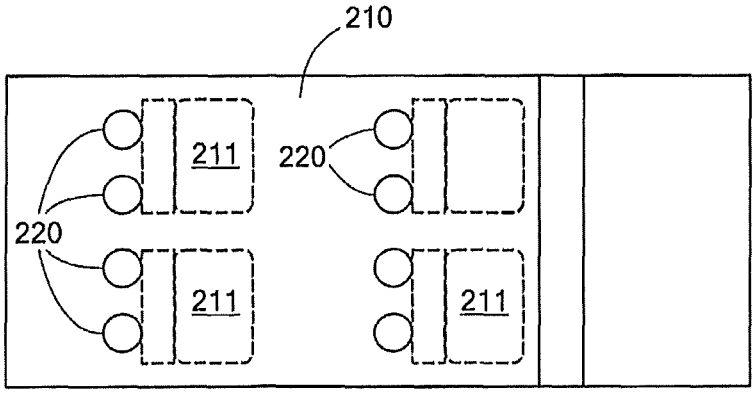
FIG. 6 is a schematic illustration of a top plan view of the vehicle of FIG. 5.
Figure 7:
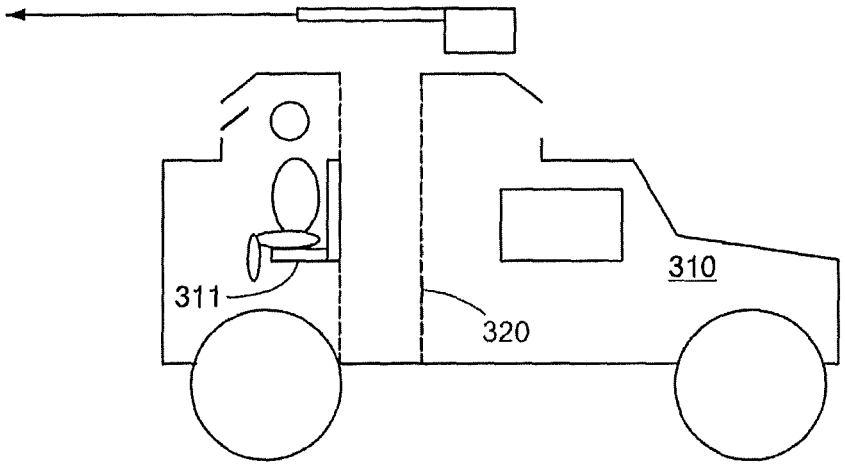
FIG. 7 is a schematic illustration of a side view of a vehicle incorporating a channel supporting a gunner's seat.

The channel 20 can be located in any suitable location within the vehicle. The center of the vehicle is generally a suitable location, because this interior space may be less used. The channel may have any suitable cross section in plan view. For example, the channel can be circular (see FIG. 2) or rectangular. A vehicle can include a single channel or multiple channels. Multiple channels could each have a smaller cross-sectional area than a single channel if used in a cluster. Referring to FIGS. 3 and 4, multiple channels 120 can be also located, for example, along the fore-aft centerline of a long vehicle 110. One or more channels 220 can also be provided at selected locations, such as behind passenger seats 211 of a vehicle 210. See FIGS. 5 and 6. In this embodiment, the seats can be structurally supported by the channels. FIG. 7 illustrates a gunner seat 311 mounted to the structural blast column 320 of a vehicle 310. In any embodiment, the channels can include a cover that can be easily pushed out during a blast event.

Figure 8:
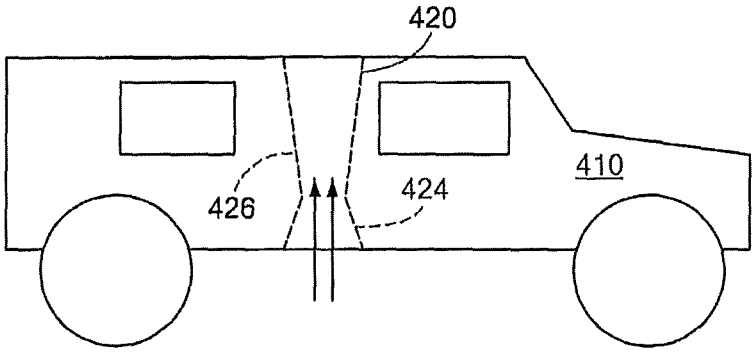
FIG. 8 is a schematic illustration of a side view of a vehicle incorporating a structural channel having a converging portion and a diverging portion.
Figure 9:
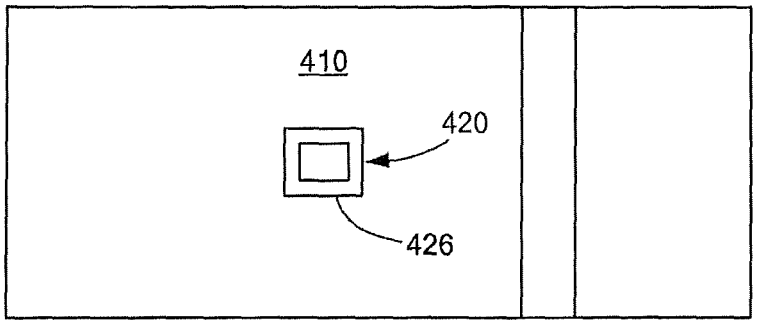
FIG. 9 is a schematic illustration of a top plan view of the vehicle of FIG. 8.

The channel can have a straight wall or walls, as shown in FIG. 1. Alternatively, the channel 420 can include converging and/or diverging wall sections 424, 426 to form a nozzle that accelerates flow through the channel and produces a downward force on the vehicle 410. See FIGS. 8 and 9. The downward force on the vehicle prevents or minimizes lifting or jumping of the vehicle off the ground. In some instances, more damage can occur to the vehicle and its occupants from landing back on the ground after lifting off than from the blast itself.

Figure 10:
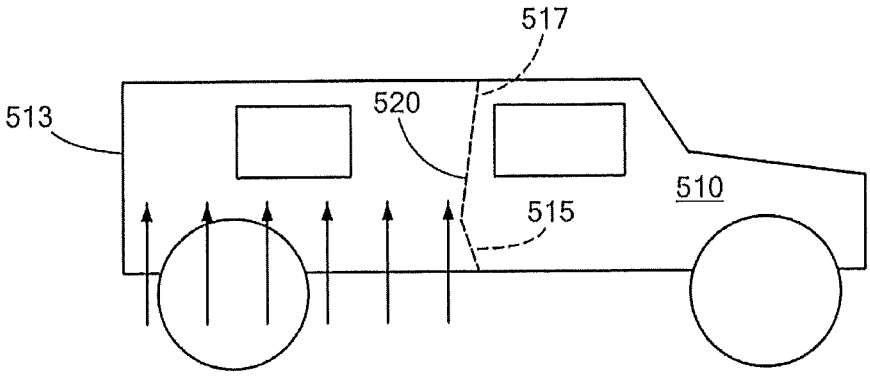
FIG. 10 is a schematic illustration of a side view of a vehicle incorporating a structural channel having a slot configuration.
Figure 11:
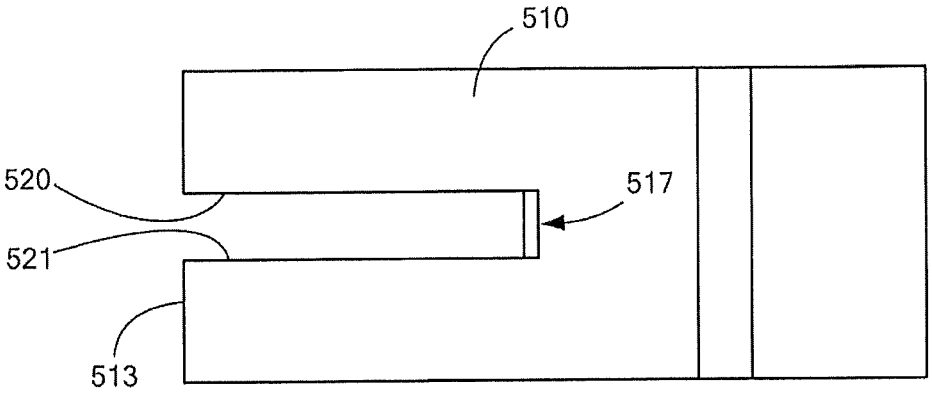
FIG. 11 is a schematic illustration of a top plan view of the vehicle of FIG. 10.
Figure 12:
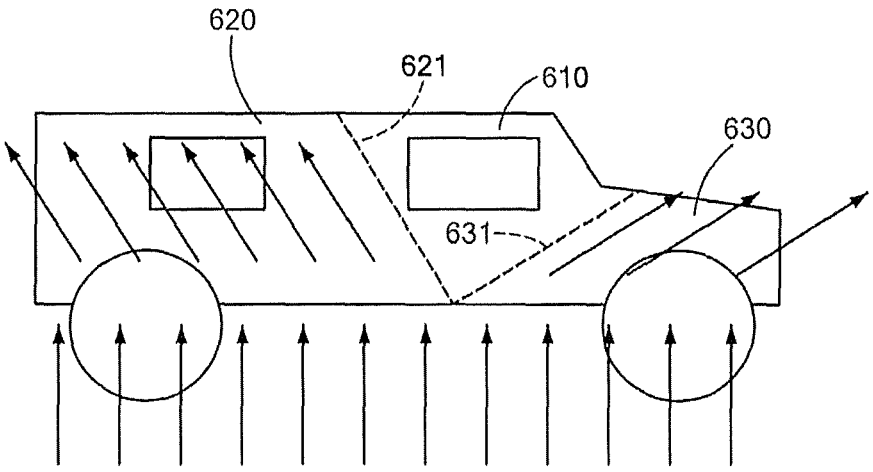
FIG. 12 is a schematic illustration of a side view of a vehicle incorporating a structural channel having a further slot configuration.
Figure 13:
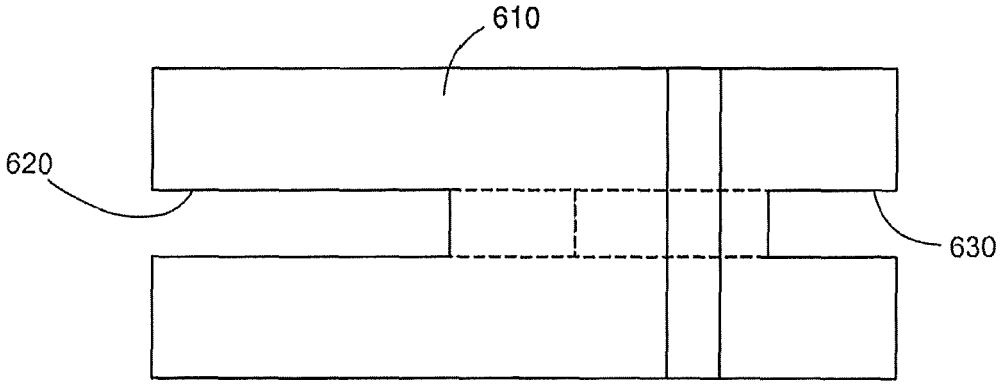
FIG. 13 is a schematic illustration of a top plan view of the vehicle of FIG. 12.

In another embodiment, the channel 520 can be in the form of one or more slots in the vehicle 510. The slots can be oriented toward the front, sides or rear of the vehicle. FIGS. 10 and 11 illustrate an embodiment in which a slot 521 is provided opening toward the rear 513 with converging and diverging wall portions 515, 517. FIGS. 12 and 13 illustrate an embodiment in which a slot 620 opens toward the rear and another slot 630 is provided opening toward the front of the vehicle. The slots can have walls 621, 631 angled to direct the blast outwardly. The slots can also have a protective surface on the inside, protecting the crew from debris moving through the slot.

The channel can be used with a variety of hull bottom shapes. For example, the hull bottom can be flat or V-shaped. The V-shaped hull can also aid in redirecting the blast energy and debris away from the vehicle.

Non-flat, angled vehicle bottoms (the so-called "V" bottom hull design) have been employed with some success in an effort to divert or guide the blast away from the vehicle, rather than taking the blast directly. However, as vehicles have gotten wider, while a significant angle to the ground needs to be maintained to make the "V" hull effective, the ground clearance has been reduced. Two problems with reduced ground clearance are: 1) reduced ground clearance from obstacles, causing the vehicles to hit the ground more easily, and 2) reduced ground clearance moves the vehicle closer to the explosion source, greatly increasing the local forces (pressures) on the hull. "Double-V" designs have been developed to help reduce the ground clearance problem, but such designs tend to trap the blast if it is centered on the vehicle. The present channel(s) can be used with an otherwise conventional "Double-V" design to reduce the vehicle's vulnerability to blasts centered under the vehicle, while preserving desired ground clearance.

Figure 14:
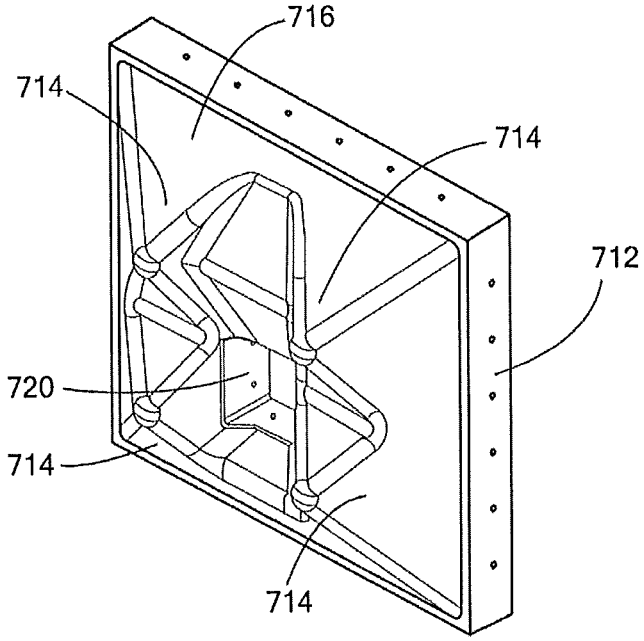
FIG. 14 is an isometric view of a hull bottom incorporating a pyramid design.

FIG. 14 illustrates a multi-faceted pyramid shaped hull 712 with a blast channel 720 integrated therein. The pyramid hull has four smaller pyramids 714 nested into the base of a larger truncated pyramid 716. The blast channel 720 is located in the center of the four smaller pyramids 714. This hull shape is also advantageous because the vehicle rides lower to the ground without giving up ground clearance. This hull shape is effective at reducing blast effects even without the blast channel.

The structural blast channel forms a stiff structural support to the floor. This stiff structural support helps to reduce blast effects, even without a vent, by supporting the floor or hull and increasing the mass presented to the blast. For example, a hollow box beam or tube or a non-hollow structural beam, such as an I-beam or C-channel, connected from the hull bottom to the roof or near the roof line stiffens the floor/hull.

While the present discussion has been focused on blasts centered under the vehicle, the present vented channel designs have also proved effective for off-center blasts. Generally, for non-vented designs, the effects of the blast are reduced as the blast moves away from the center of the vehicle. For the vented design, however, within a small area around the vent, the lowest effects are experienced if the blast is directly under the vent, and increases slightly away from the vent, but the effects are still much lower than the unvented case. Once outside the vicinity of the vent, the blast is sufficiently off center that the blast effects are reduced anyway (i.e. even for the unvented design).

The channel does two things that work together to reduce the effects on the occupants: First, the channel reduces the vertical explosive load on the vehicle hull bottom, especially at the center of the hull. Second, the channel provides a structural support to the hull bottom, reducing bottom side deflection. Directing energy into the entire vehicle, not just the hull floor, reduces the energy transferred and the effect on the crew.

A model of an expanding hemispherical debris field 840 impacting a circular plate 842 with a hole (vent) 844 at the center illustrates the reduction in vertical explosive load on the vehicle hull bottom. See FIG. 15. The purpose of this model is to determine the reduction in momentum (and energy) transferred to a circular hull bottom with a circular venting hole from a uniformly expanding debris field. The circular geometry is reasonable for a first analysis to look at the effect of the vent area as a percentage of the total area. A square bottom with a square hole would not be greatly different. It is not intended to model all the events effecting the ultimate acceleration of the hull, but to be a simple model that at least captures some of the potential for a vented system.

Figure 15:
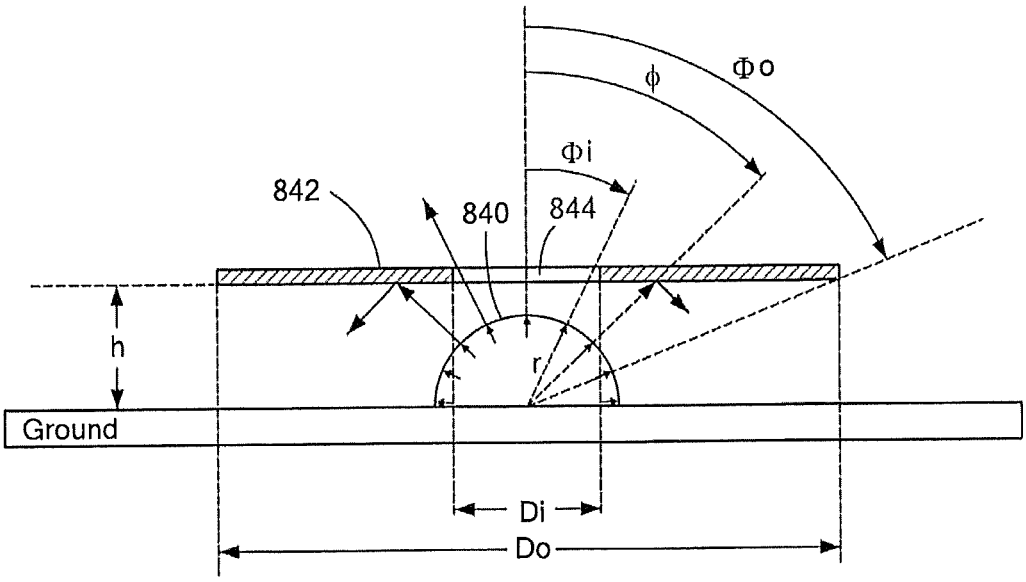
FIG. 15 is a schematic illustration of a model of an expanding hemispherical debris field impacting a circular plate with a central vent.

Consider a circular hull 842 of diameter $D_o$, with a center vent hole 844 of diameter $D_i$, placed a height h above an expanding debris field 840 of radius r as shown in FIG. 15. Particles from the debris field can travel to three different areas:

Particles within the vent angle, $0<\Phi<\Phi_i$, pass through the vent and do not transfer momentum to the hull.

Particles within the hull angle, $\Phi_i<\Phi<\Phi_o$, interact with the hull and transfer momentum to the hull.

Particles below the edge of the hull, $\Phi_o<\Phi$, pass under the hull and do not transfer momentum to the hull.

The absolute momentum per unit surface area of the debris hemisphere is given by $$\frac{P}{2\pi r^2}.$$

The component of momentum per unit hemisphere area normal to the hull bottom (i.e. in a vertical direction) is then $$\frac{P}{2\pi r^2}\cos\phi.$$

Integrating over the portion of the hemisphere that will interact with the hull bottom, using spherical coordinates, yields the total vertical momentum transfer. The vertical fraction of the absolute momentum that can be transferred to the hull is then:

$$\boxed{P_{VerticalTransmitted} = \int_0^{2\pi}\int_{\Phi i}^{\Phi o}\frac{P}{2\pi r^2}\cos\phi r^2\sin\phi\, d\phi\, d\theta}$$

Carrying out the integration yields:

$$\boxed{P_{VerticalTransmitted} = \frac{P}{2}(\cos 2\Phi i - \cos 2\Phi o)}$$

The ratio of the momentum transferred with a vent to that without a vent gives an indication of the effectiveness of the vent. The fraction of vertical momentum that is transferred to the vented plate in comparison to the unvented case is then:

$$\begin{aligned} MomentumFraction &= \frac{P_{VT-Vented}}{P_{Vt-NoVent}} \\ &= \frac{\frac{P}{2}(\cos 2\Phi i - \cos 2\Phi o)}{\frac{P}{2}(\cos 2\Phi i - \cos 2\Phi o)} \\ &= \frac{(\cos 2\Phi i - \cos 2\Phi o)}{(1 - \cos 2\Phi o)} \end{aligned}$$

$$\boxed{MomentumFraction = \frac{(\cos 2\Phi i - \cos 2\Phi o)}{(1 - \cos 2\Phi o)}}$$

Assuming the plate with the vent has the same mass as the plate without the vent, then the fraction of kinetic energy transferred for the vented case in comparison to the unvented case is just the Momentum Fraction squared. The equal mass assumption is reasonable because the mass of the vehicle with the vent would be close to that without the vent. The Energy Fraction is then:

$$EnergyFraction = \left\{ \frac{(\cos 2\Phi i - \cos 2\Phi o)}{(1 - \cos 2\Phi o)} \right\}^2$$

Figure 16:
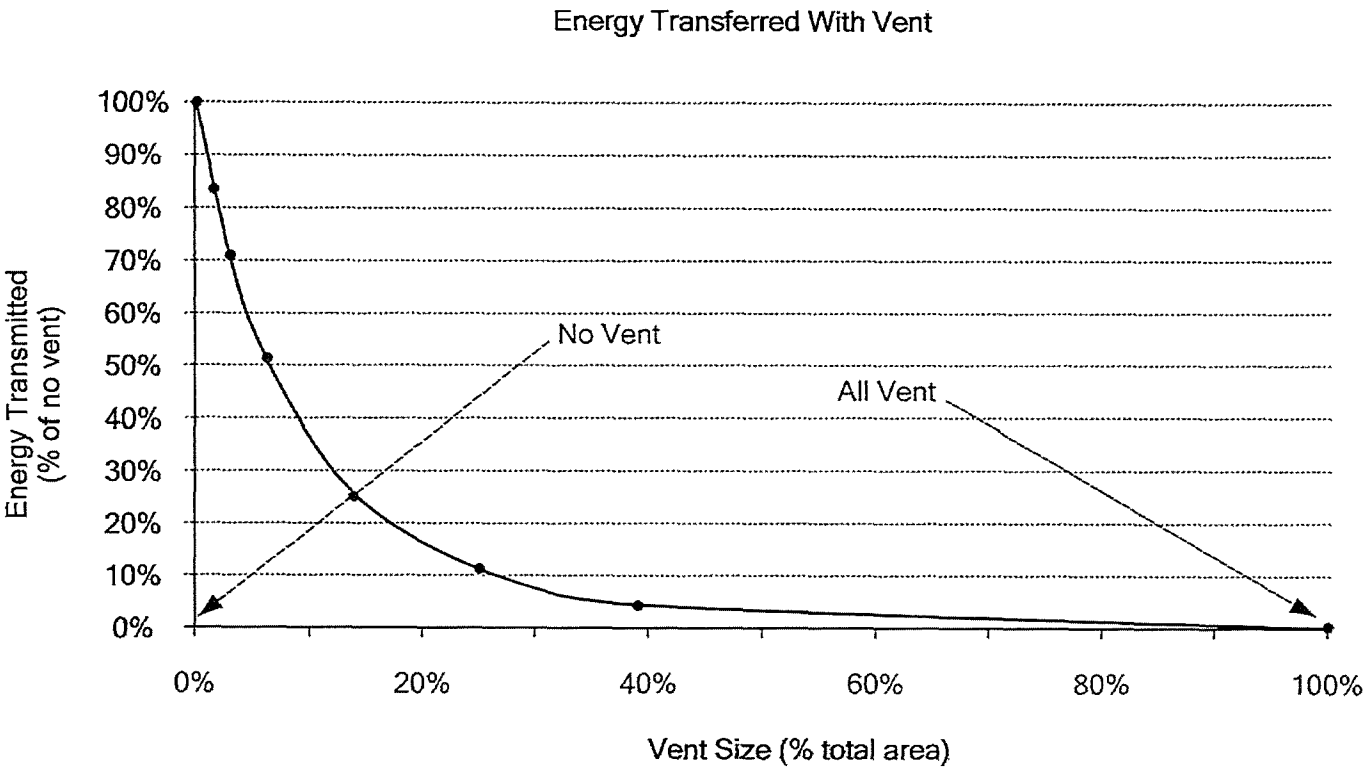
FIG. 16 is a plot of energy transferred based on the model of FIG. 15.

FIG. 16 shows the effect of the vent on the energy transferred. A 10% vent area can produce a 40% reduction in momentum transferred and a 64% reduction in energy transferred. This is because the center hole not only releases a portion of the debris field, it releases the portion that has the most direct angle to the hull bottom.

Test results have shown that the reduction may be further improved because the debris field is more energetic in the center where the vent is located, something that the uniform debris field model dose not account for. Also, test results have shown a further improvement in the reduction by tapering of the vent tube, and by shaping the hull bottom, from that of a flat plate.

As noted above and as discussed in conjunction with the models below, the present channel is effective in combination with a rigid hull. To investigate benefits of a rigid hull floor, consider a simplified vehicle under an applied impulse pressure loading from the bottom. Before the vehicle has had a chance to displace substantially, the impulse has come and gone, leaving the structure in a state of motion (i.e. velocity). It is this state of motion that the structure needs to deal with, and protect the occupants.

Figure 17A:
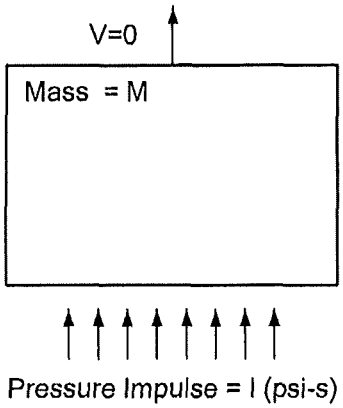
FIGS. 17A and 17B illustrate an idealized completely rigid vehicle with a pressure impulse acting over a bottom of the vehicle.
Figure 17B:
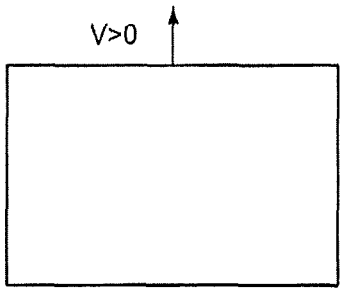

Consider first an idealized completely rigid vehicle as illustrated in FIGS. 17A, 17B. The pressure impulse I acts over the bottom area A of the vehicle of mass M (FIG. 17A), producing a state of motion characterized by the upward velocity of the entire vehicle at velocity V (FIG. 17B). Assuming the pressure impulse acts uniformly over the area A, the resulting velocity is given by:

$$\begin{aligned} V &= \int_{Impulse\ Duration} a\,dt \\ &= \int_{Impulse\ Duration} \frac{F}{M}\,dt \\ &= \int_{Impulse\ Duration} \frac{PA}{M}\,dt \\ &= \frac{A}{M}\int_{Impulse\ Duration} P\,dt \\ &= \frac{A}{M} I. \end{aligned}$$

where a is the vertical acceleration and t is time. The resulting kinetic energy is then:

$$E_K = \frac{1}{2}MV^2 = \frac{1}{2}M\left(\frac{AI}{M}\right)^2 = \frac{1}{2}\frac{A^2I^2}{M}.$$

As an example, consider a 21,000 pound vehicle with a 44 $ft^2$ hull area acted on by a pressure impulse of 500 psi-ms. The resulting velocity, using the rigid assumption, is 4.9 ft/sec (3.3 mph). The vehicle is moving upward and on a collision course with the occupants who have not yet been acted on. Fortunately, the velocity is low, and the impact will be similar to dropping the occupants into their seats from a height of 4 inches (i.e. dropping an object from a height of 4 inches results in a velocity of 4.9 ft/s). The total kinetic energy in the body is about 7,700 ft-lb.

Figure 18A:
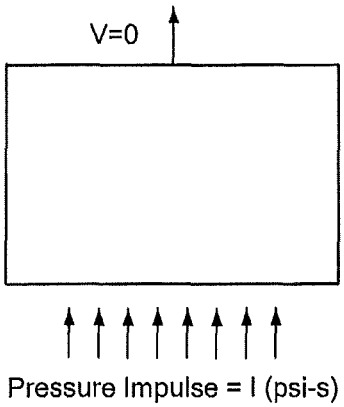
FIGS. 18A and 18B illustrate an idealized vehicle with a compliant hull bottom and a pressure impulse acting over the bottom.
Figure 18B:
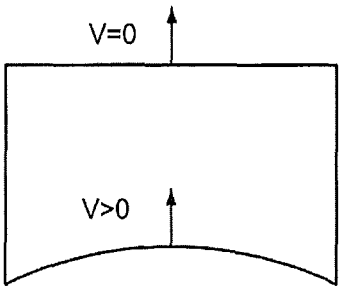

Consider next a vehicle with a compliant hull bottom acted on by the same pressure impulse loading as the rigid hull, illustrated in FIGS. 18A, 18B. The impulse (FIG. 18A) now results in the hull bottom flexing upward at a velocity resulting from the impulse, while the body is motionless (FIG. 18B).

Figure 19A:
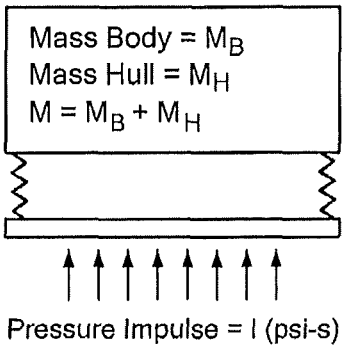
FIGS. 19A and 19B illustrate an idealized vehicle with a rigid hull bottom connected to the body with springs.
Figure 19B:
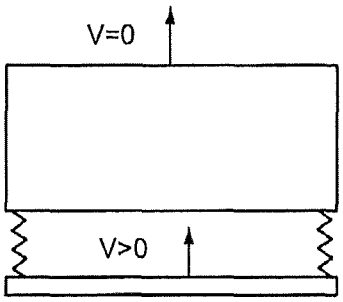

In order to simplify the flexible nature of the hull bottom, consider a rigid hull bottom connected to the body with springs, illustrated in FIGS. 19A, 19B. This simple model should still capture the general nature of the flexible hull as it affects the occupants. The velocity of the hull bottom just after the impulse (FIG. 19B) is given by:

$$V_H = \frac{A}{M_H} I$$

and the kinetic energy is given by:

$$E_{K-H} = \frac{1}{2}\frac{A^2I^2}{M_H}$$

If the hull bottom weighs 1000 pounds (of the total 21,000 lb), the velocity just after the impulse is 102 fps (about 70 mph) and the kinetic energy in the hull bottom is 162,000 ft-lb. This is now roughly equivalent to dropping the occupants into their seats from a height of 160 feet. This is a worse situation for the occupants compared to the rigid case.

This model demonstrates the so-called "slapping" effect of a compliant hull bottom into the vehicle (and occupants), which is a real effect and can be detrimental. The occupants need to be completely isolated from the hull bottom under this condition.

An increasingly rigid floor design can also, however, increase the likelihood of hull breach under the explosive load. Thus, a rigid hull floor in combination with a channel(s) to vent blast energy and gas and debris minimizes this possibility and can provide a beneficial synergy.

Figure 20:
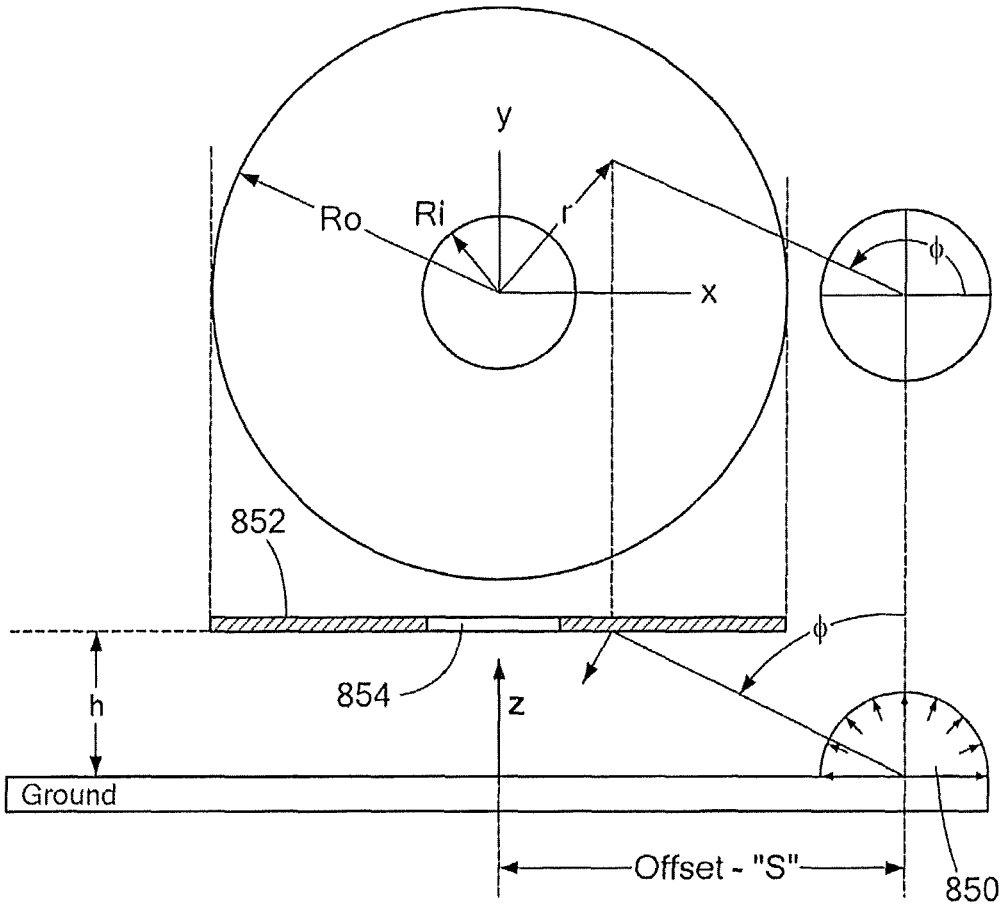
FIG. 20 is a schematic illustration of a model of an expanding hemispherical debris field offset from the center of a circular plate with a central vent.

It is also useful to understand the effect of an off center blast and to look at the effectiveness of the vent channel with less than optimum placement, since the location of a blast cannot be determined in advance. Referring to FIG. 20, the hull bottom is modeled as a circular disk 852 of radius $R_o$ with a hole 854 in the center, the vent hole, of radius $R_i$. The hull bottom is located a distance h above the ground. An explosion occurs on the ground at the right side, shown by the expanding hemispherical debris field 850 of total momentum P. The explosion is offset by a distance S from the center of the vent hole.

$$x = R \sin\phi \cos\theta + S$$

$$y = R \sin\phi \sin\theta$$

$$z = R \cos\phi$$

For the condition Z=h:

$$R = \frac{h}{\cos\phi}$$

and $$x = h\tan\phi\cos\theta + S$$

$$y = h\tan\phi\sin\theta$$

$$z = h$$

This yields a function of two variables for integration. The integration is done differently than for the centered case. Here, the integration is over the entire field of the expanding hemisphere, but the integrand is set to zero if the debris is outside of the annulus defined by $R_i \le r \le R_o$ $$P_{Fraction} = \int_0^{2\pi}\int_0^{\frac{\pi}{2}} \begin{Bmatrix} \frac{P}{2\pi} & R_i \le r \le R_o \\ 0 & r < R_i \cup r > R_o \end{Bmatrix} \cos\phi \sin\phi \, d\phi \, d\theta$$

Where:

$r = \sqrt{x^2 + y^2}$ $x = h\tan\phi\cos\theta + S$ $y = h\tan\phi\sin\theta$

Figure 21:
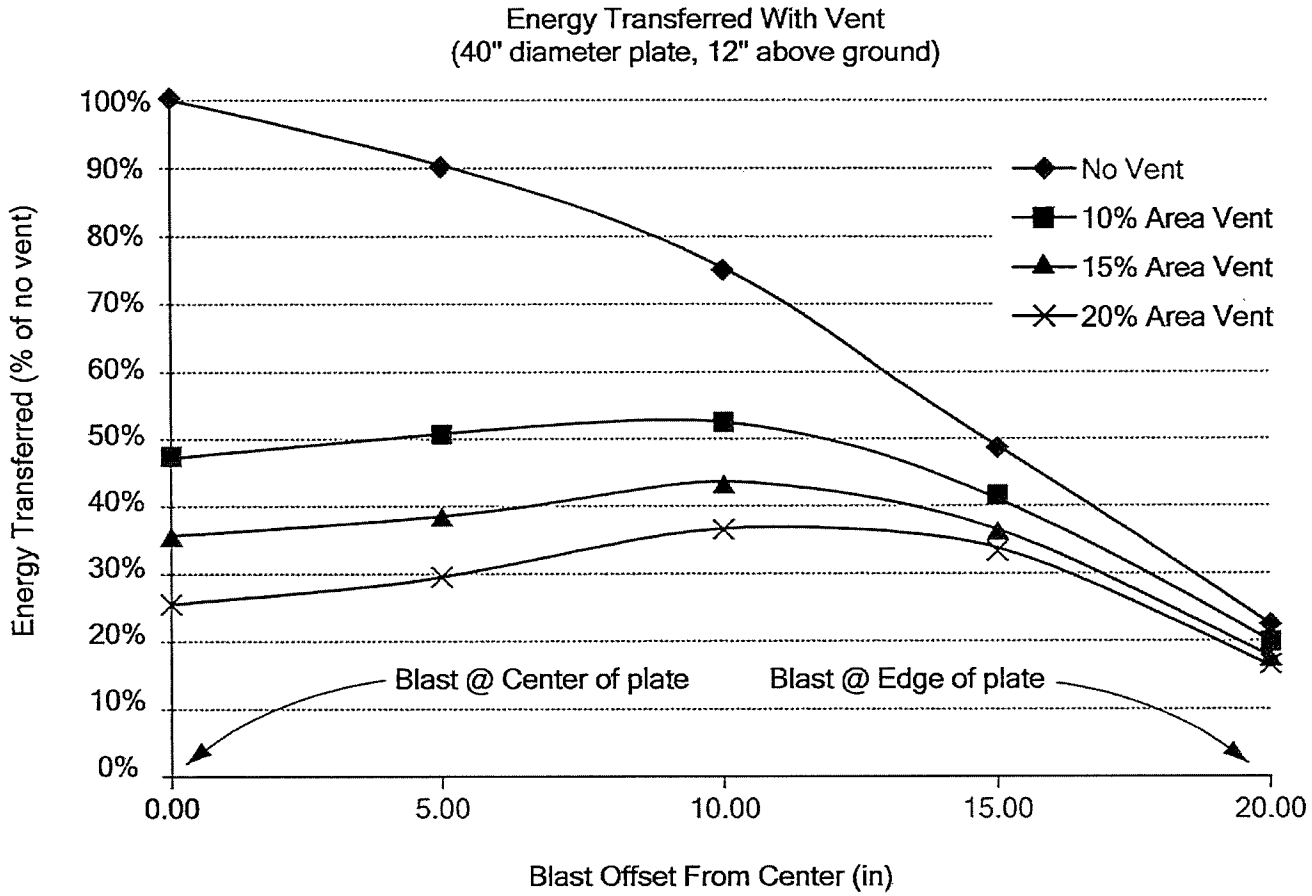
FIG. 21 is a plot of energy transferred based on the model of FIG. 20.

Calculating the fraction of momentum and energy for the vented versus unvented case, in a similar manner to the centered case, results in the Energy Fraction plot shown in FIG. 21. While there is an increase in energy transferred, as the blast moves off center, the vent is still effective, as seen in the plot.

Structural blast channels can also be taken as any pathway that vents blast waves and debris around the vehicle to lower the blast effects and improve survivability. Thus, redirecting blast channels can be provided to lower blast effects and improve survivability. The force resulting from redirecting the flow with a redirecting blast channel can counteract the effects of other forces resulting from the blast. The force is generated by changing the momentum of the blast effluent, which can be accomplished without changing the magnitude of the velocity, or speed, of the flow. Changing the direction of the flow is all that is needed to create a force. This is beneficial, because the device does not need to meet the blast effluent head on, but rather from the side. Force F is defined by Newton's second law of motion as the time rate of change of momentum P with respect to time t:

$$F = \frac{dP}{dt}$$

Figure 22:
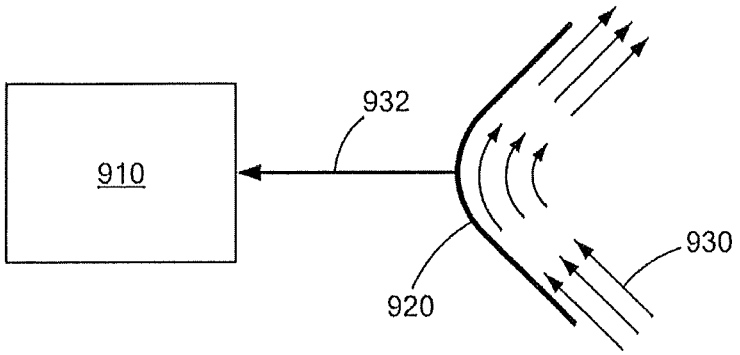
FIG. 22 is a schematic illustration of a redirecting element to create a force on a body in a desired direction.
Figure 23:
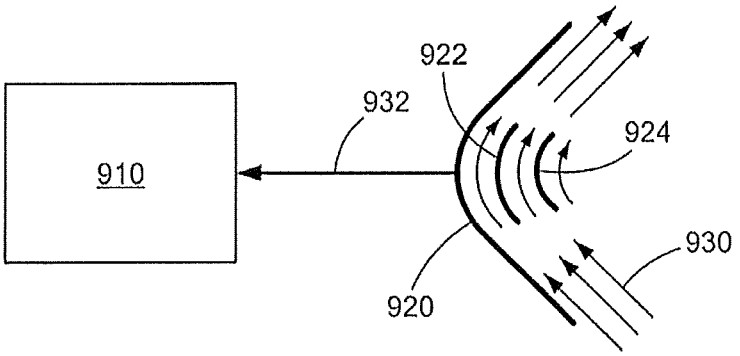
FIG. 23 is a schematic illustration of a redirecting element with sub-elements.

Force F and momentum P are both vectors. Thus, as illustrated schematically in FIG. 22, the direction of a flow field 930 can be changed by a redirecting element 920 to create a force 932 acting on a body such as a vehicle 910. Multiple sub-elements 922, 924 may also be contained in a single redirecting element, in a layered or cascaded configuration, as illustrated schematically in FIG. 23.

Figure 24:
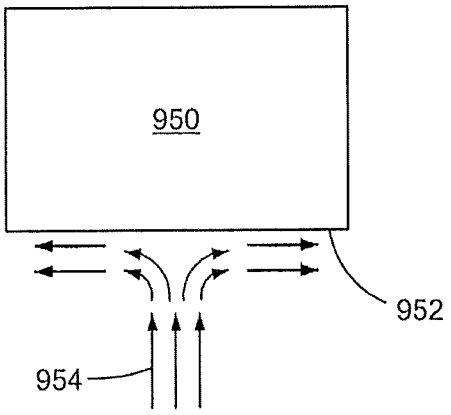
FIG. 24 is a schematic illustration of a blast centered beneath a flat bottom of a vehicle hull.
Figure 25:
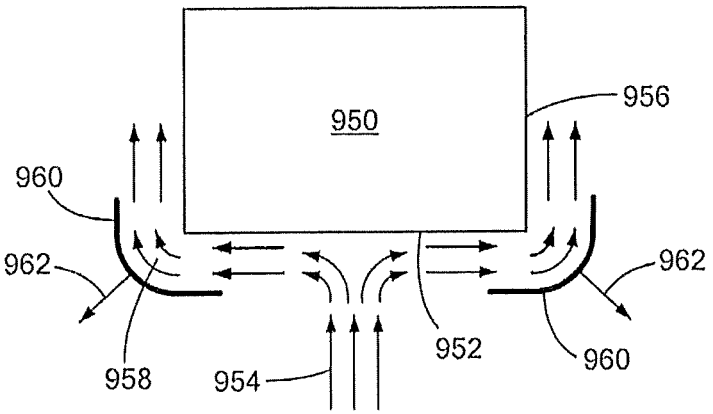
FIG. 25 is a schematic illustration of the vehicle hull of FIG. 24 with redirecting channels.

FIG. 24 schematically illustrates a vehicle hull 950 with a flat bottom 952 without redirecting elements, with a blast (schematically indicated by arrows 954) centered beneath the flat bottom. FIG. 25 schematically illustrates a vehicle hull 950 with a flat bottom 952 and redirecting channels 960 attached along the side edges of the vehicle in any suitable manner, such as with struts (not shown). The redirecting channels redirect the flow (schematically indicated by arrows 958) to produce a force (schematically indicated by arrow 962) on the channels having a component in a downward direction, tending to hold the vehicle down.

Figure 26:
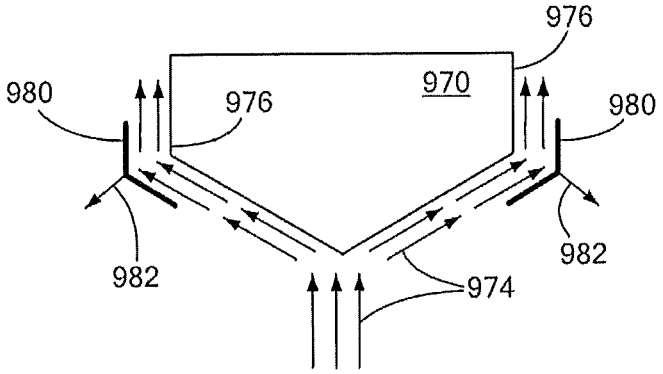
FIG. 26 is a schematic illustration of a vehicle with a V-hull and redirecting channels along side edges.
Figure 27:
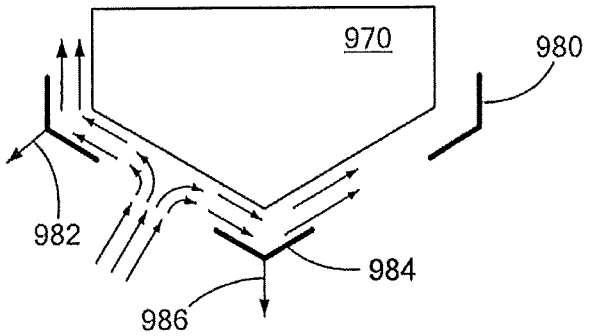
FIG. 27 is a schematic illustration of the vehicle of FIG. 26 and a center redirecting channel.

FIG. 26 schematically illustrates a vehicle 970 with a V-hull and redirecting channels 980 attached along the side edges 976 of the vehicle hull. The redirecting channels redirect the flow from a blast (schematically illustrated by arrows 974) centered beneath the hull to produce a force (schematically illustrated by arrow 982) on the channels having a component in a downward direction, tending to hold the vehicle down. FIG. 27 schematically illustrates a vehicle 970 with a V-hull and a center redirecting channel 984 for off center blasts, which also redirects the flow to produce a force on the channels in a downward direction that tend to hold the vehicle down.

Figure 28:
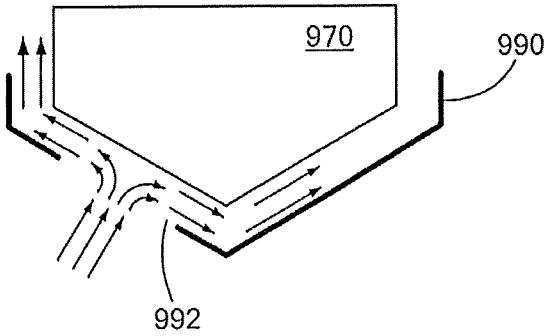
FIG. 28 is a schematic illustration of a redirecting channel having a rupturable portion.

The redirecting blast channel can also form a thin shell 990 that extends over a large portion of the hull bottom and up along the sides to an extent. See FIG. 28. The area 992 of the shell exposed to the most direct portion of the blast ruptures and allows the blast effluent to enter the space between the shell and the hull. The hull can be strengthened to be capable of surviving the directed blast where the shell ruptures. The shell is strong enough to effectively redirect the effluent moving between the shell and the hull. This embodiment tends to self adjust to different blast locations that may not be centered under the vehicle, and reduces blast effects and improves survivability.

Figure 29:
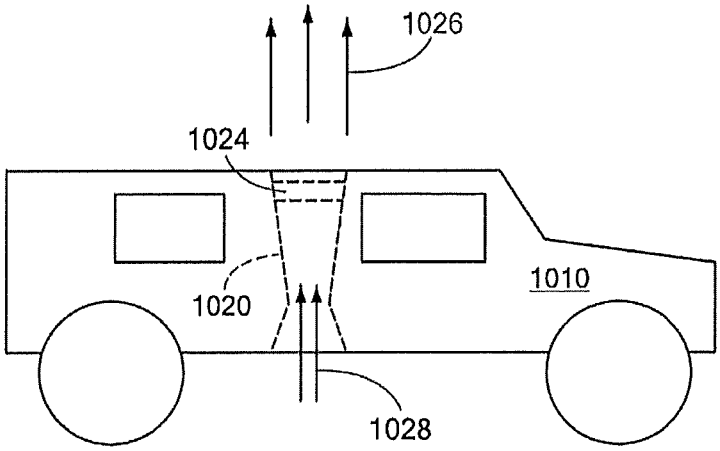
FIG. 29 is a schematic illustration of a vehicle incorporating a channel with a mechanism to produce an upward force.

In a further aspect of the mitigating effect of a blast on a vehicle, referring to FIG. 29, the channel or channels 1020 in a vehicle 1010 can include a mechanism 1024 to produce an upward force (schematically illustrated by arrow 1026) to hold the vehicle down during an explosion located beneath the vehicle (schematically illustrated by arrows 1028). For example, in the embodiment illustrated, combustible material (such as solid rocket fuel) is located within the channel and provides an upward thrust, similar to an after-burner used in a jet engine. The fuel can be ignited in any suitable manner, such as by the explosive products that move through the channel or by an ignition source triggered electronically. In another example, a counter-reactive force can be produced by the release of compressed gas.

Figure 30:
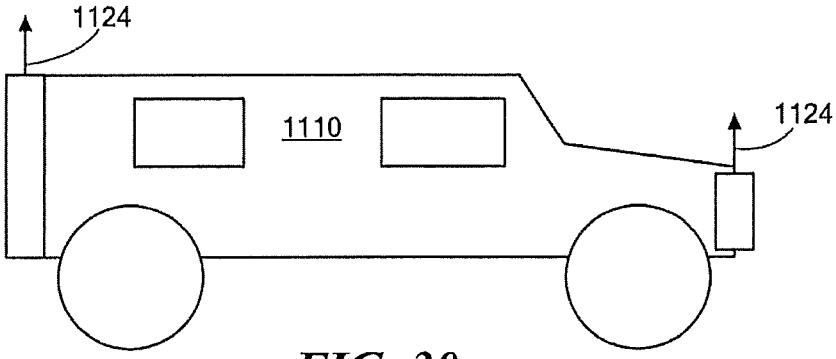
FIG. 30 is a schematic illustration of a side view of a vehicle incorporating a mechanism to provide a reactive hold down force.
Figure 31:
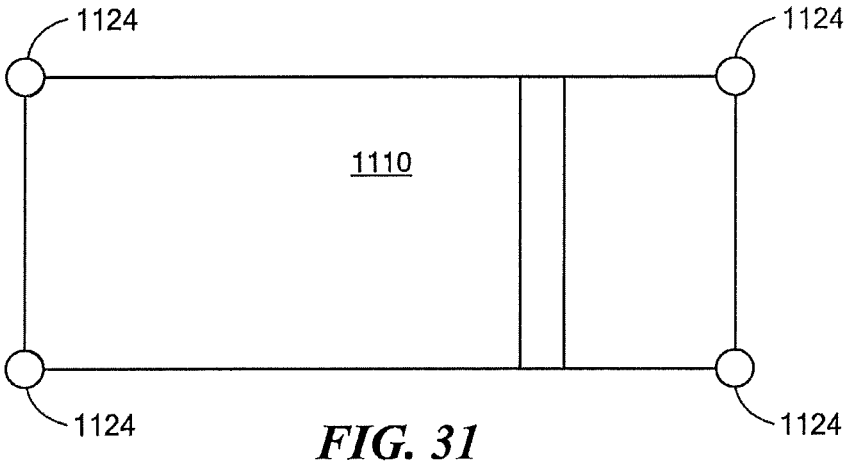
FIG. 31 is a top view of the vehicle of FIG. 30.

In another aspect of mitigating the effects of a blast on a vehicle, the vehicle can include a mechanism to produce an upward force to hold the vehicle down during an explosion located beneath the vehicle. For example, referring to FIGS. 30-31, a rocket 1124 is located at each corner of the vehicle 1110. The rockets are initiated by a shock event, for example, using an air bag type of detonation device. The rocket thrust is directed upwardly, which produces a force tending to hold the vehicle down. The rocket burn time is short, sufficient to last the duration of the blast event. In another example, a counter-reactive force can be produced by the release of compressed gas.

Figure 32:
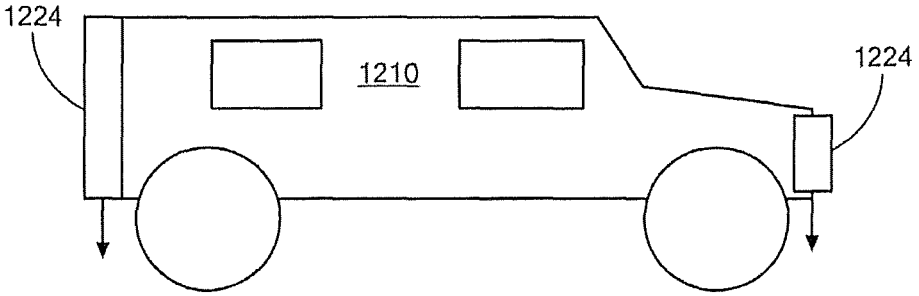
FIG. 32 is a schematic illustration of side view of a vehicle incorporating a mechanism to provide a reactive landing force.
Figure 33:
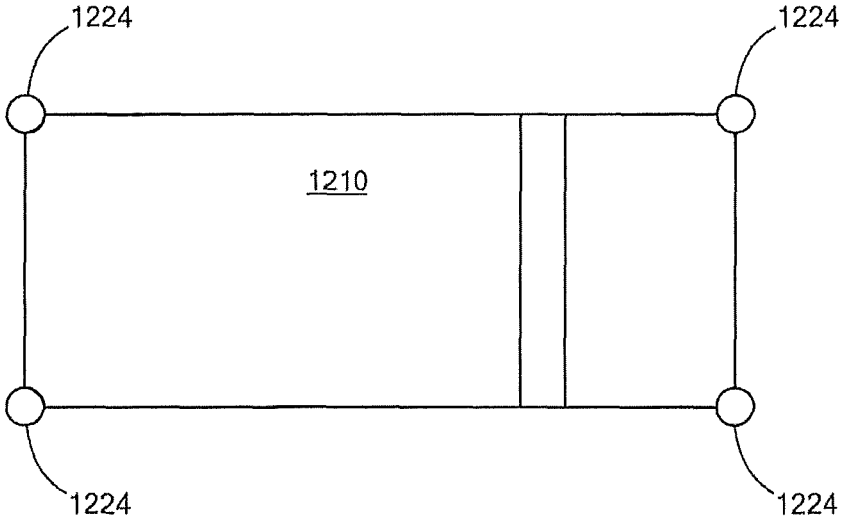
FIG. 33 is a top view of the vehicle of FIG. 32.

In a further aspect, the vehicle can include a mechanism to produce an additional downward force to counter the upward force produce by the explosion and subsequent landing back on the ground. For example, referring to FIGS. 32-33, a rocket 1224 is located at each of the four corners of the vehicle 1210. The rockets are initiated by a shock event, for example, using an automotive air bag type of detonation device. The rocket thrust is directed downwardly, which produces a force counter to the force of an explosion tending to lift the vehicle off the ground. The rocket burn time is short, sufficient to last the duration of the blast event. In another example, a counter-reactive force can be produced by the release of compressed gas.

Any suitable sensing device, such as an accelerometer, can be used to sense when the vehicle is accelerating upwardly or downwardly, and any suitable control mechanism can be provided to actuate either the downward force or the upward force, as necessary to counteract the blast lifting the vehicle up and the subsequent landing.

Figure 34:
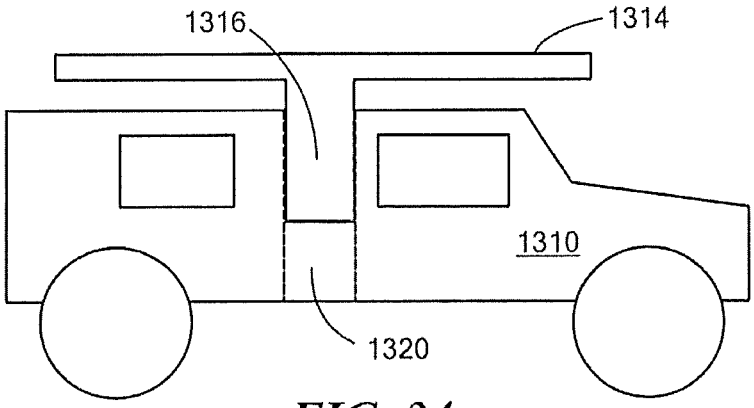
FIG. 34 is a schematic illustration of a side view of a vehicle including a platform mounted in the channel.
Figure 35:
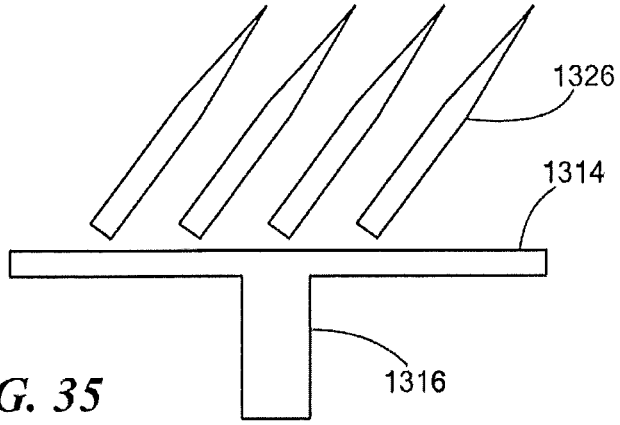
FIG. 35 is a schematic illustration of the platform of FIG. 34 to mount rocket launchers.
Figure 36:
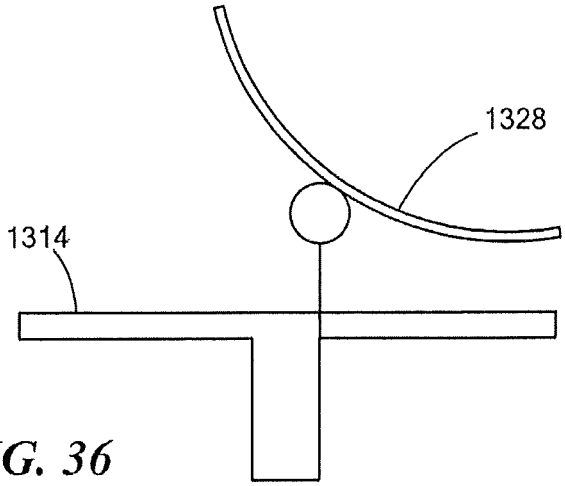
FIG. 36 is a schematic illustration of the platform of FIG. 34 to mount a radar device.

The structural blast channel or channels described above can also serve as a mount for a platform or for accessories. For example, FIG. 34 illustrates a general platform 1314 mounted to the blast channel 1320 of a vehicle 1310. The platform can be mounted or removed quickly. The platform can include a leg or stem 1316 that slips into the channel. The channel can remain open for blast mitigation if the leg or stem is also hollow and the platform includes an opening therein. A fastening mechanism, such as a pin, can be used if desired to hold the platform to the mount. Spacers (not shown) to space the platform above the vehicle roof can be used if desired. The mount is a structural portion of the vehicle and can be disposed over the center of gravity of the vehicle, which aids to maintain stability. For example, FIG. 35 schematically illustrates the platform 1314 used to mount rocket launchers 1326, and FIG. 36 illustrates a radar device 1328 mounted to the platform 1314.

Figure 37:
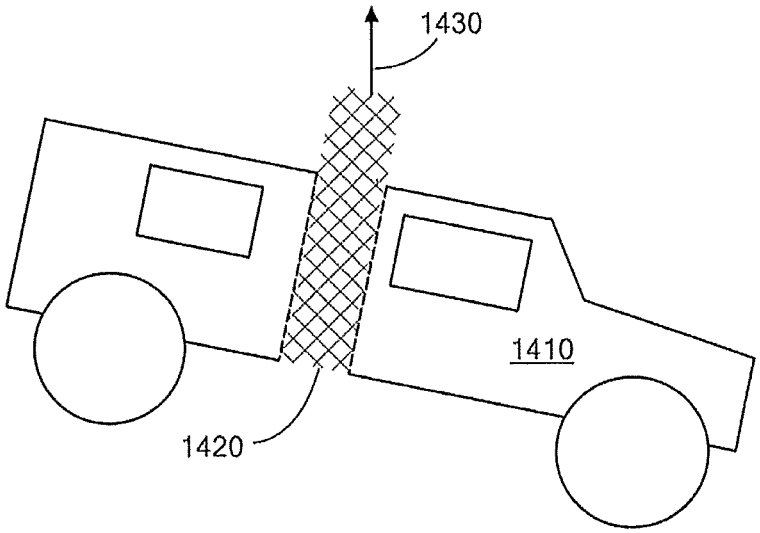
FIG. 37 is a schematic illustration of a vehicle pick point from above.
Figure 38:
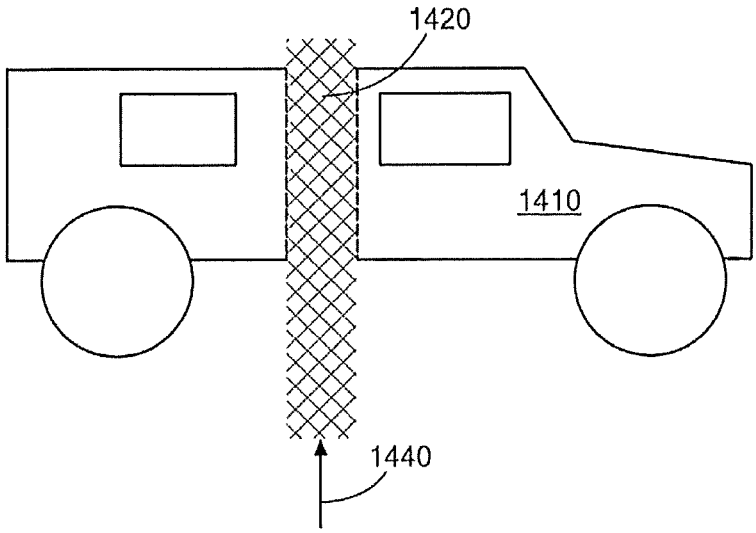
FIG. 38 is a schematic illustration of a vehicle pick point from below.

The structural blast channel can be used as a single pick point to lift or service the vehicle. A device 1430, 1440 can be inserted into the channel 1420 from either the top or the bottom of the vehicle 1410 to pick or to lift the vehicle off the ground, as illustrated schematically in FIGS. 37 and 38.

In another aspect, the blast channel can be flexible and stored out of the way most of the time, such as by folding or rolling, and it can open or inflate when a blast occurs. A flexible channel can be made from, for example, a reinforced rubber or another composite material. It can be incorporated within other structural elements to provide structural support to the vehicle.

It will be appreciated that the embodiments and aspects of the present invention can be combined with each other in various ways. The invention is not to be limited by what has been particularly shown and described, except as indicated by the appended claims.

What is claimed is:

1. A vehicle product comprising:

a structural enclosure of a vehicle, the structural enclosure including a hull floor and enclosing a compartment for crew, cargo, or crew and cargo; and a structural vent channel attached to and forming a structural component of the structural enclosure, the structural vent channel configured to vent energy and effluent from a blast originating beneath the vehicle through the structural enclosure, the structural vent channel comprising:

a channel providing a passage extending vertically through the compartment and comprising a plurality of walls extending from an open bottom end at the hull floor to an open top end at or above an upper surface of the structural enclosure, the walls structurally attached at the bottom end to the hull floor and forming a stiff structural support to the floor; and a rectangular cross section at all locations between the open bottom end and the open top end.

2. The vehicle product of claim 1, wherein the open top end is disposed above a ceiling of the compartment, and the passage is sealed from the compartment.

3. The vehicle product of claim 1, wherein the channel is attached at the top end to a roof of the structural enclosure.

4. The vehicle product of claim 1, wherein the channel includes a tube, a hollow box beam, or a non-hollow structural beam, the non-hollow structural beam comprising an I-beam or a C-channel.

5. The vehicle product of claim 1, wherein the hull floor comprises a rigid floor.

6. The vehicle product of claim 1, wherein the hull floor comprises a V shape.

7. The vehicle product of claim 1, wherein the hull floor comprises multiple pyramid shapes nested within a base of a larger truncated pyramid shape.

8. The vehicle product of claim 1, further comprising a slot opening toward a rear of the vehicle hull.

9. The vehicle product of claim 1, wherein the channel further includes a cover that can be pushed out during a blast event.

10. The vehicle product of claim 1, further comprising one or more additional channels extending vertically through the compartment from an open bottom end to an open top end, each of the channels comprising one or more walls attached at the bottom end to the hull floor, the open top end disposed above a ceiling of the compartment, each of the channels providing a passage through the vehicle, the passage sealed from the compartment.

11. The vehicle product of claim 1, further comprising a reaction producing source disposed within the channel and triggerable in response to an explosive force beneath the vehicle.

12. The vehicle product of claim 11, wherein the reaction producing source comprises a source of compressed gas, an explosive device, or a rocket.

13. The vehicle product of claim 1, further comprising a surface shaped to redirect a blast flow originating beneath the structural enclosure along a pathway around the vehicle, the surface comprising a redirecting element attached to the structural enclosure adjacent a side of the hull floor.

14. The vehicle product of claim 13, further comprising an additional element nested within the redirecting element, the additional element having a surface shaped to redirect a blast flow originating beneath the structural enclosure.

15. The vehicle product of claim 1, wherein the channel comprises a mount for a platform or an accessory.

16. The vehicle product of claim 15, wherein the accessory comprises a radar device.

17. The vehicle product of claim 1, wherein the channel comprises a pick point for lifting or picking the vehicle off the ground.

18. A vehicle including the vehicle product of claim 1.

19. The vehicle of claim 18, wherein the vehicle comprises an armored vehicle.

* * * * *